United States Patent [19]

Garlapaty

[11] Patent Number: 4,471,686

[45] Date of Patent: Sep. 18, 1984

[54] DOUBLE ACTING PISTON AND CYLINDER ASSEMBLY

[75] Inventor: Venkat R. Garlapaty, Utica, Mich.

[73] Assignee: Greenco Corporation, Dearborn, Mich.

[21] Appl. No.: 378,516

[22] Filed: May 17, 1982

[51] Int. Cl.[3] ..... F15B 15/26

[52] U.S. Cl. ..... 92/24; 92/22; 92/27

[58] Field of Search ..... 92/14, 15, 22, 23, 24, 92/27, 28, 29, 61, 62, 65, 129, 140, DIG. 1, DIG. 4

[56] References Cited

U.S. PATENT DOCUMENTS

| | | | |
|---|---|---|---|
| 2,324,724 | 7/1943 | Rapple et al. | 92/28 |
| 2,325,775 | 8/1943 | Horton | 92/28 |
| 2,338,069 | 12/1943 | Horton et al. | 92/28 |
| 2,364,715 | 12/1944 | Horton et al. | 92/14 |
| 2,515,712 | 7/1950 | Horton et al. | 92/14 |
| 3,353,455 | 11/1967 | Berry | 92/24 |
| 3,831,999 | 8/1974 | Sonneborn | 92/DIG. 4 |

*Primary Examiner*—Robert E. Garrett
*Assistant Examiner*—Richard L. Klein
*Attorney, Agent, or Firm*—Gifford, VanOphem, Sheridan, Sprinkle & Nabozny

[57] ABSTRACT

A double acting piston and cylinder arrangement comprising an elongated cylinder and a piston assembly slidably mounted within the cylinder. The piston assembly comprises a first part and a second part which are axially adjacent each other and movable with respect to each other between a locking and nonlocking position. In the locking position, the piston assembly forces a split ring radially outwardly and against the walls of the cylinder to lock the piston assembly to the cylinder at any adjusted position. Conversely, in its nonlocking positon the ring contracts radially inwardly and permits the piston assembly to freely axially slide along the cylinder.

7 Claims, 4 Drawing Figures

DOUBLE ACTING PISTON AND CYLINDER ASSEMBLY

BACKGROUND OF THE INVENTION

1. Field of the Invention

The present invention relates generally to a double acting piston and cylinder arrangement and, more particularly, to such an arrangement with means for locking the piston to the cylinder at any adjusted position of the piston within the cylinder.

2. Description of the Prior Art

There are a number of previously known double acting piston and cylinder arrangements comprising an elongated cylinder and having a piston assembly longitudinally slidably mounted within the cylinder. Pressurization of the cylinder on one side of the piston assembly longitudinally drives the piston assembly in one direction while, conversely, pressurization of the cylinder on the opposite side of the piston assembly drives the piston assembly in the opposite direction.

A number of previously known double acting piston and cylinder assemblies also include means for braking the piston assembly to the cylinder at an adjusted position of the piston along the cylinder. These previously known devices with braking means, however, are disadvantageous in that they are unduly complex and expensive in construction. Moreover, the braking means for many of these devices utilize a wedge carried by the piston and which engages only one side of the cylinder when in its braking or locked position. Such wedges, however, tend to gall the surface of the cylinder wall and ultimately necessitate expensive repair or replacement of the cylinder.

SUMMARY OF THE PRESENT INVENTION

The present invention provides a double acting piston and cylinder arrangement with means for locking the piston to the cylinder at any adjusted position.

In brief, the piston and cylinder arrangement according to the present invention comprises an elongated cylinder and a piston assembly slidably mounted within the cylinder. The piston assembly divides the cylinder into a first subchamber between one end of the piston assembly and one end of the cylinder wall, similarly, a second subchamber between the other end of the piston and the other end of the cylinder. Pressurization of the first chamber drives the piston assembly towards the second chamber and vice versa.

The piston assembly further comprises a first piston part and a second part which are axially adjacent each other. The piston parts are secured together by means which permit limited axial movement between the piston parts. The piston parts are movable between a locked and unlocked position with respect to each other.

The first piston part includes an outwardly tapered portion and a split ring is positioned around this tapered portion. In its locked position, the tapered portion of the first piston part forces the split ring outwardly and into frictional engagement with the cylinder walls thus locking the piston assembly to the cylinder at its adjusted position. Conversely, in its unlocked position, the split ring contracts radially inwardly from the cylinder walls which enables the piston assembly to freely slide along the cylinder. Pressurization of either cylinder subchamber moves the piston parts to their unlocked position.

The double acting piston and cylinder arrangement of the present invention can be utilized in any number of different applications. However, in the preferred form of the invention, the piston assembly is attached by a band to a load so that movement of the piston assembly simultaneously moves the load.

BRIEF DESCRIPTION OF THE DRAWING

A better understanding of the present invention will be had upon reference of the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
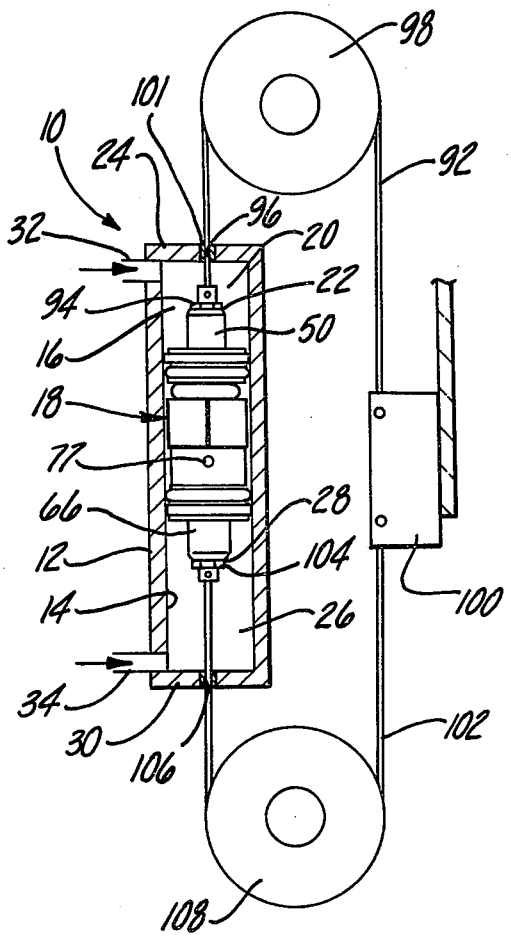
FIG. 1 is a diagrammatic view illustrating a preferred embodiment of the piston and cylinder arrangement of the present invention.

With reference first to FIG. 1, a preferred embodiment of the double acting piston and cylinder arrangement 10 according to the present invention is thereshown and comprises an elongated cylinder 12 having interior walls 14 which define an elongated and generally cylindrical chamber 16. A piston assembly 18, which will be subsequently described in greater detail, is positioned within the cylinder chamber 16 and thus defines a first or upper subchamber 20 between one end 22 of the piston assembly 18 and one end 24 of the cylinder 12. Similarly, the piston assembly 18 defines a second or lower subchamber 26 between the other end 28 of the piston assembly 18 and the other or lower end 30 of the cylinder 12.

A conventional fluid port 32 is formed in the cylinder 12 which is open to the upper subchamber 20 while a second fluid port 34 is formed on the cylinder 12 and open to the lower subchamber 26. These fluid ports 32 and 34 are connected to a fluid system (not shown) having means to selectively pressure either the upper subchamber 20 or lower subchamber 26. In the preferred form of the invention, the fluid system is a pneumatic system.

Figure 2:
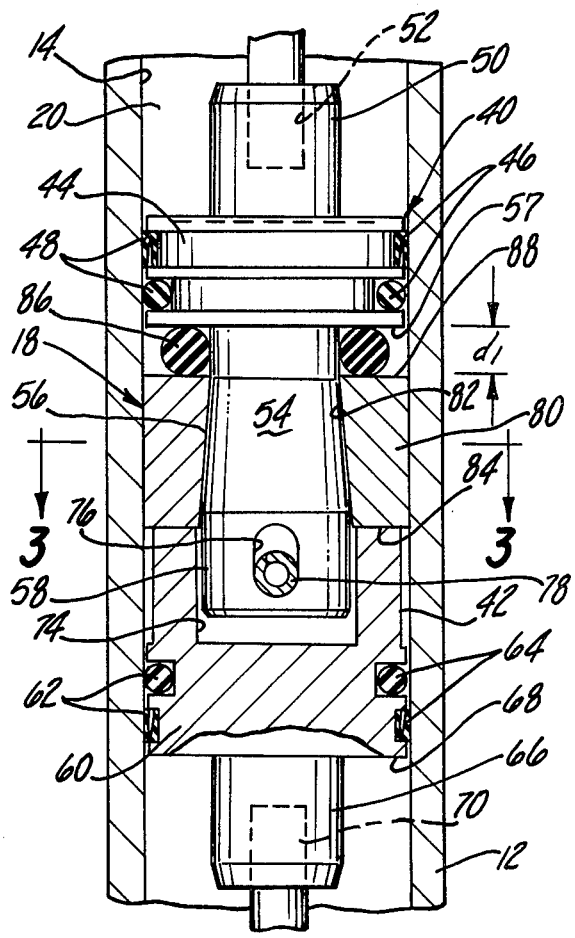
FIG. 2 is a longitudinal sectional view illustrating a preferred embodiment of the piston and cylinder arrangement of the present invention.
Figure 3:
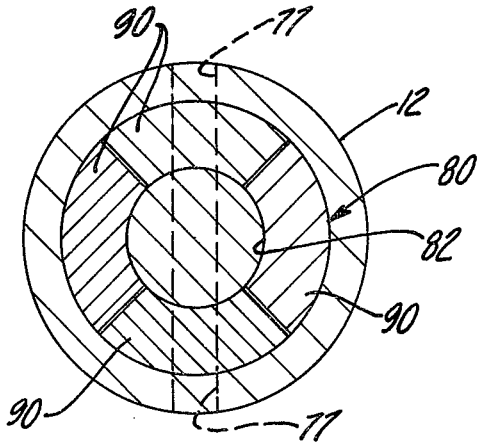
FIG. 3 is a cross sectional view taken substantially along line 3—3 in FIG. 2.

With reference now to FIGS. 2 and 3, the piston assembly 18 is thereshown in greater detail and comprises an upper piston part 40 and a lower piston part 42. The upper piston part 40 includes a cylindrical portion 44 having at least one and preferably two annular channels 46 formed around its outer periphery. These channels 46 carry fluid seals 48 which sealingly engage the interior walls 14 of the cylinder 12. A boss 50 having internally threaded bore 52, extends axially upwardly from the cylindrical portion 44.

An elongated axial extension 54 protrudes downwardly from the lower end 57 of the cylindrical portion 44. The extension 54 includes an outwardly tapered portion 56 which increases in cross sectional area as the tapered portion 56 becomes more spaced from the cylindrical portion 44. In the preferred form of the invention, the tapered portion 56 is frusto-conical in shape and terminates in a lower cylindrical end 58.

Still referring to FIG. 2, the lower piston part 42 comprises a cylindrical portion 60 having at least one and preferably two annular channels 62 formed about its outer periphery. These annular channels 62 carry fluid seals 64 which sealingly engage the interior walls 14 of the cylinder 12. An axial boss 66 having internally threaded bore 70 extends downwardly from the lower end 68 of the cylindrical portion 60.

A cylindrical axis recess 74 is formed at the upper end of the lower piston part cylindrical portion 60. The lower cylindrical end 58 of the upper piston part 40 is axially slidably received within the recess 74 as shown in FIG. 2.

Figure 4:
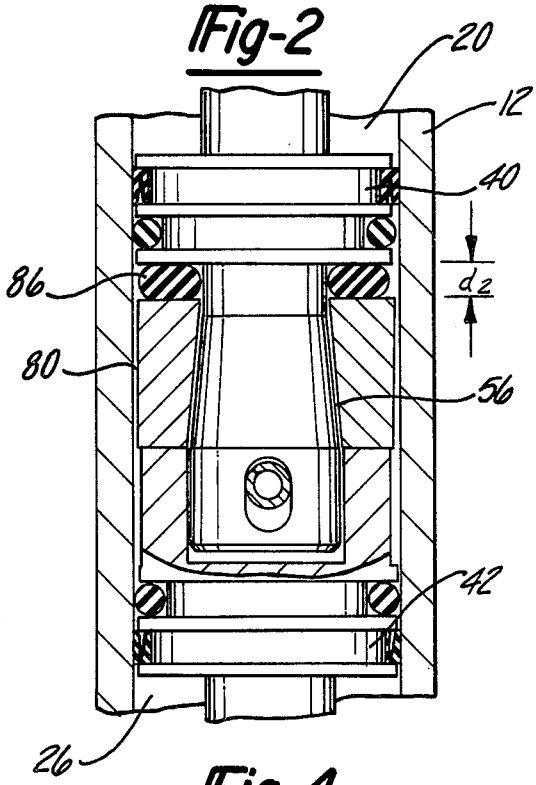
FIG. 4 is a sectional view similar to FIG. 2 but showing the piston assembly in an unlocked position.

A diametrically extending and axially elongated slot 76 is formed through the cylindrical end 58 of the upper piston part 40 and this slot registers with holes 77 in the lower piston part 42. A roll pin 78 is inserted through the holes 77 and the slot 76 thus securing the upper and lower piston parts 40 and 42 together. The slot 76, however, permits the piston parts 40 and 42 to axially move relative to each other between a locking position in which the roll pin 78 is positioned at the bottom of the slot 76 (FIG. 2), and an unlocked position in which the roll pin 78 is positioned at the top of the slot 76 (FIG. 4).

With reference now particularly to FIGS. 2 and 3, a ring 80 having an interior bore 82 which conforms with the tapered portion 56 of the first piston part 40 and an outer cylindrical surface is positioned around the tapered portion 56. The ring 80 is axially dimensioned so that the lower end 84 of the ring 80 abuts against the second piston part 42. A spring, such as an O-ring 86, is sandwiched in between the other or upper end 88 of the ring 80 and the lower end 57 of the first piston part cylindrical portion 44.

Still referring to FIGS. 2 and 3, the ring 80 is radially expandable with respect to the axis of the piston assembly 18. In the preferred form of the invention, the ring 80 comprises at least two and preferably four circumferential segments 90 (FIG. 3) which are radially movable independently of each other. The ring 80 is preferably constructed of bronze, phenolic or other types of material having a high coefficient of friction but which is sufficiently soft that it cannot score or gall the inner walls 14 of the cylinder 12.

The outside diameter of the ring 80 is dimensioned so that, with the piston parts 40 and 42 in their locked position (FIG. 2), the tapered portion 56 of the first piston part 40 forces the ring segments 90 radially outwardly and against the walls 14 of the cylinder 12. Simultaneously, the upper end 88 of the ring 80 is spaced apart from the lower end 56 of the portion 44 by the distance d1 (FIG. 2). In doing so, the outer surface of the ring 80 frictionally engages the cylinder 12 and locks the piston assembly 18 to the cylinder 12 at any longitudinal position therealong. Conversely, when the piston parts 40 and 42 are in their unlocked position (FIG. 4) the tapered portion 56 permits the ring 80 to contract radially inwardly thus releasing the piston assembly 18 to slide along the cylinder 12. Simultaneously, the spring 86 compresses somewhat between the upper portion part 40 and the ring 80 so that the distance d2 (FIG. 4) between the ends 56 and 88 of the portion 44 and ring 80, respectively, is less than d1.

With reference now to FIG. 1, an elongated band 92 is secured at one end to the boss 50 of the first piston part 40 by a fastener 94 which engages the threaded bore 52. The band 92 extends outwardly through a slot 96 in the cylinder end 44, around a pully 98 and is attached at its other end to a load 100. Conventional fluid seals 101 are provided around the slot 96 to seal the band 92 to the cylinder 12.

Similarly, a second band 102 is secured at one end to the boss 66 on the second piston part 42 by a threaded fastener 104 which engages the threaded bore 70. The second band 102 extends outwardly through a slot 106 in the lower end 30 of the cylinder 12, around a pully 108 and is attached at its other end to the load 100. Conventional fluid seals are provided around the slot to fluidly seal the second band 102 to the cylinder 12.

The axial position of the piston assembly 18 within the cylinder 12 controls the vertical position of the load 100. For example, as the piston assembly 18 moves downwardly in the cylinder 12 as viewed in FIG. 1, the load 100 moves upwardly and vice versa.

The operation of the present invention will now be described assuming that the piston parts 40 and 42 are initially in their locked position as shown in FIG. 2. With the piston parts 40 and 42 in their locked position, the piston assembly 18 is secured against axial movement to the cylinder 12 and the load 100 is stationary.

Assuming that the upper cylinder chamber 20 is pressurized by the fluid system, the pressurization causes the upper piston part 40 to shift axially downwardly toward the lower piston part 42 and thus move the piston parts 40 and 42 to their unlocked position (FIG. 4). Upon the further pressurization of the upper cylinder chamber 20, the piston assembly 18 moves axially downwardly in the cylinder 12 thus moving the load 100 upwardly.

Upon the subsequent depressurization of the upper cylinder chamber 20, the weight of the load 100 together with the force from the spring 86 moves the upper piston part 40 upwardly in the cylinder 12 and thus to its locked position. In doing so, the tapered portion 56 of the upper piston part 40 forces the ring 80 outwardly and against the cylinder walls 14 thus locking the piston assembly 18 to the cylinder 12 at any adjusted position therealong.

Similarly, pressurization of the lower piston chamber 26 causes the lower piston part 42 to shift upwardly thus moving the piston parts 40 and 42 to their unlocked position. The further pressurization of the lower cylinder chamber 26 moves the entire piston assembly upwardly in the cylinder 12. Upon the subsequent depressurization of the lower cylinder chamber 26, the tension from the load 100 together with the force from the spring 86 moves the piston parts 40 and 42 to their locked position, again securing the piston assembly 18 against movement to the cylinder 12 at its adjusted axial position.

A primary advantage of the double acting piston and cylinder arrangement of the present invention is that the ring 80, when in its locked position, frictionally engages the cylinder around substantially its entire interior. Consequently, the present invention greatly minimizes or altogether eliminates galling of the cylinder walls by the locking wedges as has been known to occur with the previously known devices.

A still further advantage of the piston and cylinder arrangement of the present invention is that it is relatively inexpensive in construction and virtually maintenance free.

Having described my invention, however, many modifications thereto will become apparent to those skilled in the art to which it pertains without deviation from the spirit of the invention as defined by the scope of the appended claims.

I claim:

1. A double acting piston and cylinder assembly comprising:

an elongated cylinder having an interior wall, a piston assembly comprising a first part and a second part, said first and second piston parts being axially adjacent each other, said piston assembly being positioned in said cylinder and dividing said cylinder into a first chamber between one end of the first piston part and one end of said cylinder and a second chamber between one end of the second piston part and the other end of the subchamber, each of said chambers adapted for fluid pressurization, means for attaching the other ends of said piston parts together so that said piston parts are axially movable between a locked and unlocked position with respect to each other, means carried by said piston assembly for frictionally locking said piston assembly to said cylinder when said piston parts are in said locked position, wherein said first piston part comprises a tapered portion and wherein said locking means comprises a radially expandable and contractable ring having an inner bore said ring positioned around said first piston part tapered portion so that the inner bore of said ring is closely adjacent said tapered portion and so that one end of said ring abuts against said second piston part, spring means for urging said piston parts to said locked position, said spring means disposed between the other axial end of said ring and said first piston part.

2. The invention as defined in claim 1 wherein said ring comprises at least two circumferentially adjacent segments.

3. The invention as defined in claim 2 wherein said ring comprises four circumferentially adjacent segments.

4. The invention as defined in claim 1 wherein said spring means comprises an O-ring constructed of a resilient material.

5. The invention as defined in claim 1 wherein said tapered portion is frusto-conical in shape.

6. The invention as defined in claim 1 wherein said second piston part comprises a cylindrical axial recess formed at its other end and into which an end of said tapered portion is received, and wherein said attaching means comprises a pin secured to said second piston part and extending through an axially elongated slot in said end of said tapered portion.

7. The invention as defined in claim 1 and comprising a first elongated band secured at one end to said one end of said first piston part, a second elongated band secured at one end to said one end of said second piston part, a load, and means for securing the other ends of said bands to said load.

* * * * *

UNITED STATES PATENT AND TRADEMARK OFFICE

CERTIFICATE OF CORRECTION

PATENT NO. : 4,471,686

DATED : September 18, 1984

INVENTOR(S) : Venkat Garlapaty

It is certified that error appears in the above-identified patent and that said Letters Patent is hereby corrected as shown below:

Column 3, line 61, "portion" should read -- piston --.

Signed and Sealed this

*Ninth* Day of *April 1985*

[SEAL]

*Attest:*

DONALD J. QUIGG

*Attesting Officer*

*Acting Commissioner of Patents and Trademarks*